US006793460B2

(12) United States Patent
DuBois

(10) Patent No.: US 6,793,460 B2
(45) Date of Patent: Sep. 21, 2004

(54) FAN WITH CROSS-BAR HOLDING ARM

(76) Inventor: Langdon DuBois, 801 Bluebird Canyon Dr., Laguna Beach, CA (US) 92651

( * ) Notice: Subject to any disclaimer, the term of this patent is extended or adjusted under 35 U.S.C. 154(b) by 0 days.

(21) Appl. No.: 10/218,842

(22) Filed: Aug. 13, 2002

(65) Prior Publication Data

US 2003/0108421 A1 Jun. 12, 2003

Related U.S. Application Data

(60) Provisional application No. 60/312,119, filed on Aug. 13, 2001.

(51) Int. Cl.[7] ..... A45B 27/00
(52) U.S. Cl. ..... 416/71; 416/70 A
(58) Field of Search ..... 416/69, 71, 73, 416/70 A; D3/1, 3, 4

(56) References Cited

U.S. PATENT DOCUMENTS

| | | | | |
|---|---|---|---|---|
| 137,413 A | * | 4/1873 | Brueck | 416/71 |
| 519,554 A | * | 5/1894 | Rubin | 416/73 |
| 2,334,298 A | * | 11/1943 | Vallone | 416/71 |

* cited by examiner

*Primary Examiner*—Edward K. Look
*Assistant Examiner*—Kimya N McCoy
(74) *Attorney, Agent, or Firm*—Rutan & Tucker

(57) ABSTRACT

The present invention is directed to fans having a handle that is disposed in a non-radial manner with respect to the center of the fan portion. In preferred embodiments the handle is substantially parallel to an imaginary circumferential tangent of the fan. In an especially preferred embodiment the fan is expanded at two radial spokes. Each of the spokes has a distal end, and the two distal ends are used to support the handle. An angle formed between the two spokes when the fan is in the expanded configuration is at least 15 degrees.

19 Claims, 3 Drawing Sheets

FAN WITH CROSS-BAR HOLDING ARM

This application claims the benefit of U.S. provisional application No. 60/312,119 incorporated herein by reference in its entirety.

FIELD OF THE INVENTION

The field of the invention is foldable fans and signs.

BACKGROUND OF THE INVENTION

Hand-held fans have been known for centuries, as both decorative and functional objects. Recent examples include U.S. design Pat. Nos. D312529, D389301, D338778, and D334951.

Fans usually contain a body portion and a handle. The body portion comprises a paper or other flexible sheet, that is folded between two receiving arms. The handle can be one or two pieces, and is generally not known to be foldable. The hand portion always extends radially out from the center of the fan portion.

There is a class of fans known as pocket fans. In such fans the fan portion folds about itself to form a tight bundle, which then folds into the handle. U.S. Pat. No. 555,339 to Rubin (1896) is an example of such a fan.

SUMMARY OF THE INVENTION

The present invention is directed to fans having a handle that is disposed in a non-radial manner with respect to the center of the fan portion. In preferred embodiments the handle is substantially parallel to an imaginary circumferential tangent of the fan. In an especially preferred embodiment the fan is expanded at two radial spokes. Each of the spokes has a distal end, and the two distal ends are used to support the handle. An angle formed between the two spokes when the fan is in the expanded configuration is at least 15 degrees.

Other contemplated fans include hand held fans having a foldable material configurable between an open position and a closed position, comprising first and second spokes, and a handle that couples to the spokes to form a substantially triangular arrangement when the fan is in the open position. Such fans may have a handle that has a cavity sized and dimensioned to receive the foldable material and the spokes.

Some contemplated fans will have a foldable material portion printed with a warning. It is contemplated that it would be advantageous if the warning were discernable from a distance of at least X feet when the fan is in the open position where X is one of 15, 30, 75, 150, 300, 450, and 900. It is also contemplated that the warning will comprise a non-alphanumeric symbol, a word, or a phrase with any symbol word or phrase being positioned such that the handle is below the word or phrase when the fan is in the open position. Some contemplated words for use in the warning include the following: stop, warning, ped, pedestrian, and crossing. It is contemplated that it may be advantageous to improve visibility of fans by making at least portions of the fans reflective or luminous.

It is contemplated that in some embodiments the handle will consist essentially of one unitary piece, while other embodiments will have a multi-piece handle. In a preferred multi-piece handle, the handle comprises a first segment rotatably coupled to an end of the first spoke and a second segment rotatably coupled to an end of the second spoke, and the first and second segments are adapted to be coupled to form an elongated handle coupling the ends of the first and second spokes together. In some embodiments, the handle may be adapted to facilitate holding the fan in a stationary position perpendicular to a surface by a person standing on the surface. Some embodiments may have a handle that is shaped to conform to the shape of a hand gripping the handle. Such shape conforming handles may have a cavity sized and dimensioned to receive the foldable material and the spokes with the handle being substantially larger than the cavity and having an exterior surface dimensioned to fill the interior of a partially closed fist.

In a preferred fan the first and second spokes are each coupled to a separate edge of the folded material portion of the fan; the spokes are elongated and each have a first end rotatably coupled to a joining member; the first spoke has a second end rotatably coupled to the handle; the handle is adapted to be coupled to a second end of the second spoke while the fan is in the open position; the handle and spokes are adapted to bias the handle to remain in a fixed position relative to the spokes while the fan is in the open position; the handle has a cavity sized and dimensioned to at least partially receive the fan material and spokes when the fan is in the closed position; the handle and spokes are adapted to bias the spokes to remain at least partially within the handle when the fan is in the closed position; and the folded material portion of the fan comprises a reflective material and a warning, the warning comprising a symbol, word, or phrases visible from a distance of at least 100 feet while the fan is in the open position.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
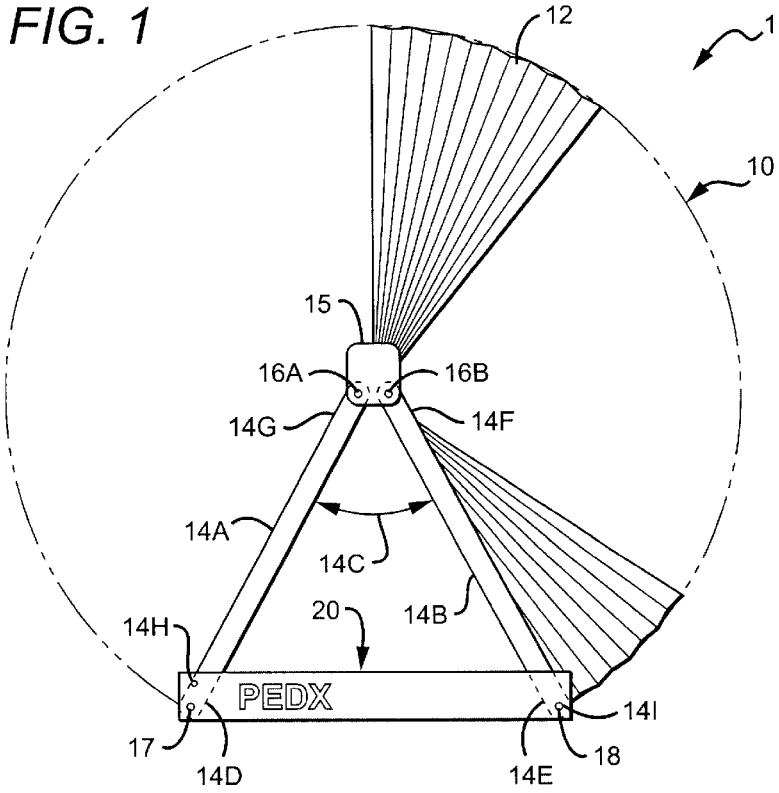
FIG. 1 is a front view of a fan embodying the invention.

In FIG. 1, an opened fan 1 according to the inventive subject matter generally has a fan portion 10 and a handle portion 20. The fan portion 10 has a paper, cloth or other foldable material 12, and two spokes 14A and 14B that are rotated about center hinges 16A and 16B, thereby folding the material 12 upon itself in a manner known to the art. Spoke 14A has another hinge 17 near its distal end, about which the handle 20 pivots. Spoke 14B has a dimple latch or other latching mechanism 18 used to detach and reattach the handle 20 to spoke 14B. An angle 14C is formed at the apparent intersection of 14A and 14B, and is contemplated to be at least 15 degrees. In a preferred embodiment, the angle 30 is between 15 and 75 degrees. In a more preferred embodiment, the angle 30 is between 20 and 60 degrees. In FIG. 1 the handle 20 is considered to be disposed in a substantially triangular relationship with the spokes 14A and 14B, even though the spokes are not technically joined to one another at an apex.

As shown in FIGS. 1–3C, the first and second spokes 14A and 14B of fan 1 are each coupled to a separate edge of the folded material portion 12; the spokes 14A and 14B are elongated and each have a first end (14F and 14G) rotatably coupled to a joining member 15; the first spoke 14A has a second end 14D rotatably coupled to the handle 20; the handle 20 is adapted to be coupled to a second end 14E of the second spoke 14B while fan 1 is in the open position; the handle 20 and spokes 14A and 14B are adapted to bias the handle to remain in a fixed position relative to the spokes while the fan is in the open position by dimple latch 14H; the handle has a cavity 22 sized and dimensioned to at least partially receive the fan material 12 and spokes 14A and 14B when the fan is in the closed position; the handle 20 and spokes 14A and 14B are adapted to bias the spokes to remain at least partially within the handle 20 when fan 1 is in the closed position by dimple latch 141; and the folded material portion 12 of fan 1 comprises a reflective material and a warning 13, the warning 13 comprising a symbol, word, or phrases visible from a distance of at least 100 feet while fan is in the open position.

Figure 2:
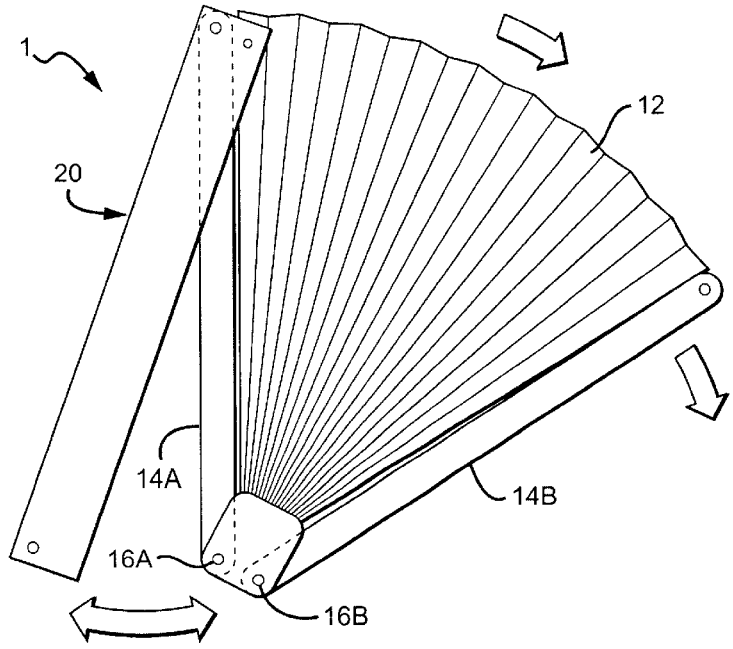
FIG. 2 is a front view of the fan of FIG. 1 in a partially folded configuration.
Figure 3:
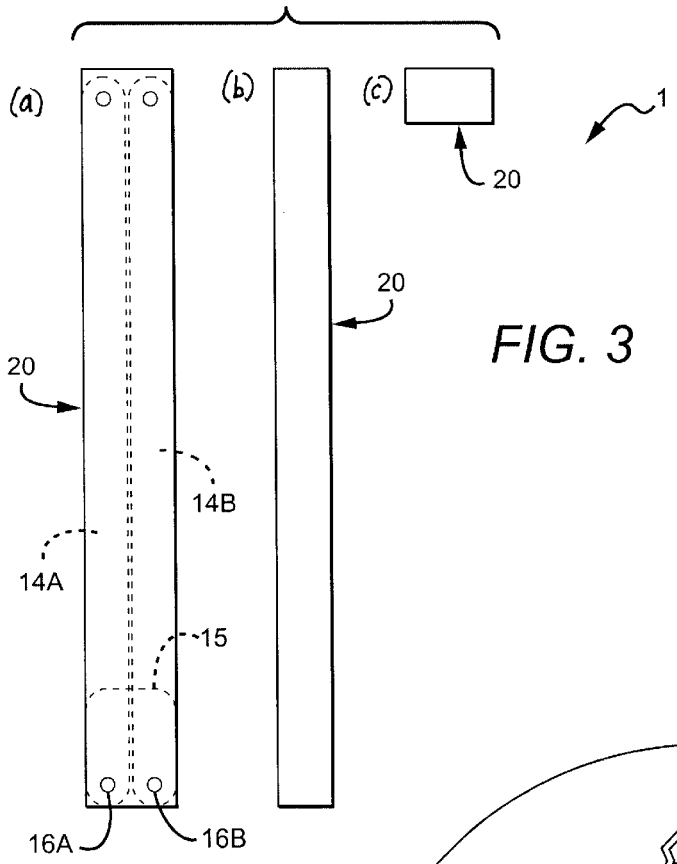
FIG. 3A is a front view of the fan of FIG. 1 in a fully folded configuration.
FIG. 3B is a side view of the fan of FIG. 1 in a fully folded configuration.
FIG. 3C is a end view of the fan of FIG. 1 in a fully folded configuration.

FIG. 2 depicts the fan 1 in a partially folded configuration. As shown in FIG. 2, the handle 20 contains an elongated cavity 22, and is open along one of its long sides. This permits the folded material 12 and spokes 14A and 14B to fold up inside the cavity as shown.

Fan 1 operates in a typical fashion in regard to spokes 14A and 14B, and folding material 12 in that rotation of spokes 14A and 14B about hinges 16A and 16B coupling them to joining member 15 results in the folding or unfolding of fan material 12.

As shown in FIG. 2, handle 20 rotates about hinge 17 relative to spoke 14A to permit spokes 14A and 14B, joining member 15, and folding material 12 to be positioned within handle 20. FIGS. 3A–3C shown fan 1 in a closed position.

Figure 4:
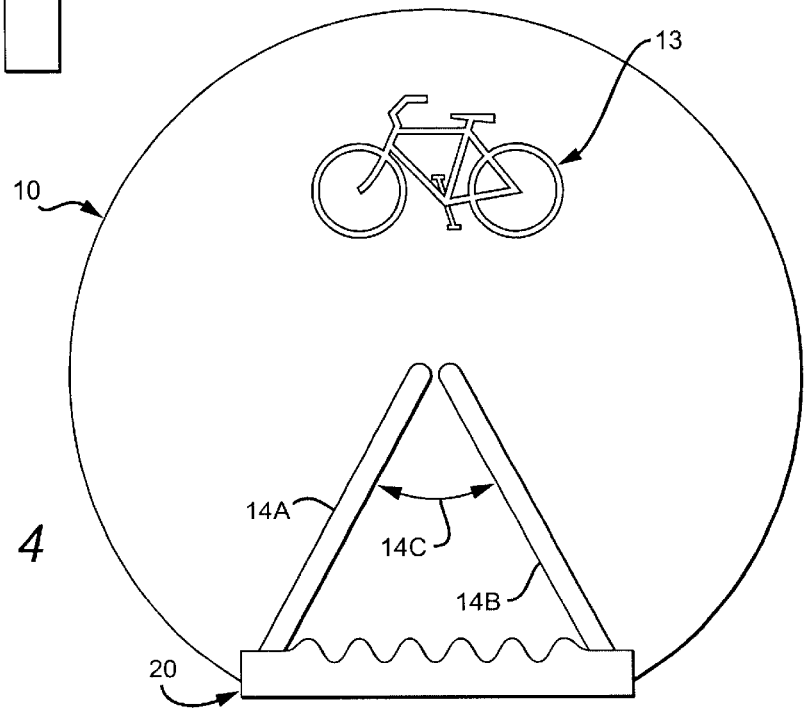
FIG. 4 is a front view of a second fan embodying the invention.
Figure 5:
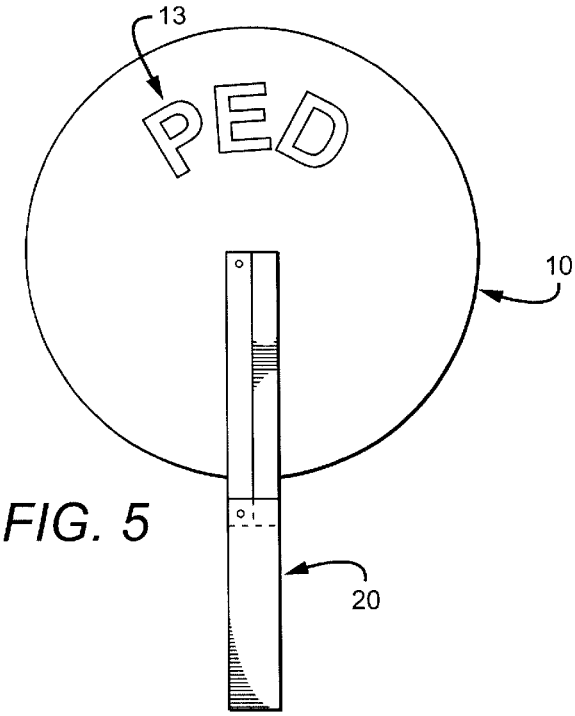
FIG. 5 is a front view of a third fan embodying the invention.
Figure 7:
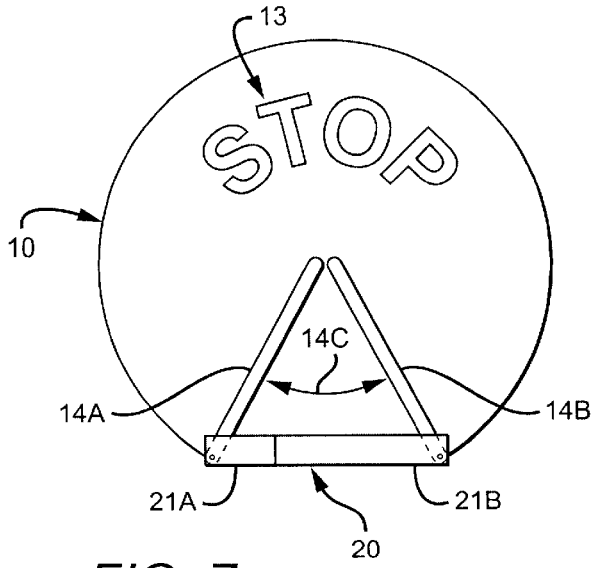
FIG. 7 is a front view of a fifth fan embodying the invention.

Fan 10 may have innumerable formats of text, images, colors, and so forth. In one class of embodiments, the fan may be used as cross-walk or other warnings. The material 12 may be brightly colored, have reflective properties, glow-in-the-dark, etc. The material may also be printed with large letters or symbols on either or both sides of the fan portion 10. For example, one side may be bright red with "STOP" lettering, while the other side may be yellow or green with "GO" lettering. Other examples of contemplated warnings 13 are shown in FIGS. 4, 5, and 7. As has been described, the warning may comprise a non-alphanumeric symbol as shown in FIG. 7, a word as in FIGS. 4 and 5, or a phrase (not shown). Fans with warning preferably have the warning 13 positioned such that the handle 20 is below the word or phrase when the fan 1 is in the open position as shown in FIGS. 4, 5, and 7. Some contemplated words for use in the warning include, but aren't limited to, the following: stop, warning, ped, pedestrian, and crossing.

It is contemplated that it may be advantageous to improve visibility of fans by making at least portions of the flans reflective or luminous. As such, fans comprising reflective folding material are contemplated, as are fans comprising reflective letters on a non-reflective folding material. It is also contemplated that some fans may be made luminous by incorporating one or more lights, LEDs or other devices.

It is contemplated that it would be advantageous if the warning were discernable from a distance of at least X feet when the fan is in the open position where X is one of 15, 30, 75, 150, 300, 450, and 900. Making the warning discernable for larger distances permits the fan to function as a sign or signal to motorists or others that they should take notice of a condition of a thing that exists at or beyond the position of the fan.

It is contemplated that in some embodiments the handle will consist essentially of one unitary piece as shown in FIG. 1, while other embodiments will have a multi-piece handle as shown in FIG. 7. In the multi-piece handle 20 of FIG. 7, the handle comprises a first segment 21A rotatably coupled to an end of the first spoke 14A and a second segment 21B rotatably coupled to an end of the second spoke 14B, and the first and second segments 21A and 21B are adapted to be coupled to form an elongated handle 20 coupling the ends of the first and second spokes 14A and 14B together.

Some embodiments may have a handle that is shaped to conform to the shape of a hand gripping the handle as shown in FIG. 4, or may comprise grooves or other griping mechanisms to enable a person to properly grip the fan. Depending on the intended use of the fan, the handle may be adapted to enable a person to obtain leverage and easily sway the fan back and forth, or may be adapted to facilitate holding the fan in a fixed position such as in position perpendicular to a surface by a person standing on the surface.

It is contemplated that shape conforming handles may have a cavity 22 sized and dimensioned to receive the foldable material and the spokes with the handle being substantially larger than the cavity and having an exterior surface dimensioned fill the interior of a partially closed fist similar to the grip of a bicycle handle, joystick, or an automobile steering wheel.

Figure 6:
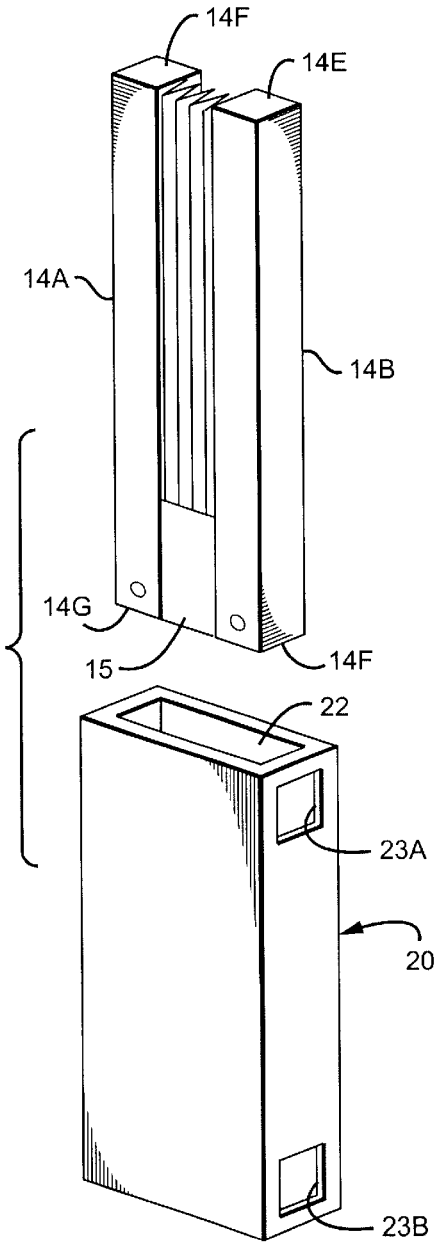
FIG. 6 is a front view of a fourth fan embodying the invention.

It should be appreciated that pivot/hinge 17 could be replaced by some other mechanism, such as another latching mechanism. In that manner, the handle 20 could be detached entirely from the remainder of the fan 1. As shown in FIG. 6, detachable handle 20 also comprises channels 23A and 23B adapted to receive ends 14D and 14E of spokes 14A and 14B when the fan is in the open position. The embodiment of FIG. 5 is one that may utilize either a handle 20 coupled to the spokes or detachable from the spokes. If detachable from the spokes, the ends of the spokes are inserted into cavity 22 when the fan is in the open position, and substantially all of the spokes and folding material are inserted into cavity 22 when the fan is in the closed position.

Handle 20 may also contain any manner of writing, images, colors, and so forth. In FIG. 1 the handle 20 contains lettering for a possible trademark "PEDX".

Thus, specific embodiments and applications of fans have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A folding, hand-held fan, having a foldable material configurable between an open position and a closed position, comprising: first and second spokes, and a handle that couples to the spokes to form a substantially triangular arrangement when the fan is in the open position.

2. The fan of claim 1, wherein the handle has a cavity sized and dimensioned to receive the foldable material and the spokes.

3. The fan of claim 1, wherein the foldable material is printed with a warning.

4. The fan of claim 3, wherein the fan is adapted so as to make the warning discernable from a distance of at least X feet when the fan is in the open position where X is one of 15, 30, 75, 150, 300, 450, and 900.

5. The fan of claim 4 wherein the warning comprises a word or phrase, the word or phrase being positioned such that the handle is below the word or phrase when the fan is in the open position.

6. The fan of claim 5 wherein the word or phrase comprises at least one of the following words: stop, warning, ped, pedestrian, and crossing.

7. The fan of claim 4 wherein the warning comprises a non-alphanumeric symbol.

8. The fan of claim 4 wherein the handle is adapted to facilitate holding the fan in a stationary position perpendicular to a surface by a person standing on the surface.

9. The fan of claim 1 wherein the handle comprises a plurality of segments.

10. The fan of claim 1 wherein the first and second spokes form an apparent angle of Y degrees where Y is at least 15.

11. The fan of claim 10 wherein Y is between 15 and 75.

12. The fan of claim 10 wherein Y is between 20 and 60.

13. The fan of claim 10 wherein Y is less than 45.

14. The fan of claim 1 wherein the handle is shaped to conform to the shape of a hand gripping the handle.

15. The fan of claim 1 wherein the handle is rotatably coupled to an end of at least one spoke.

16. The fan of claim 1 wherein the folding material comprises a reflective material.

17. A folding, hand-held fan, having foldable material configurable between an open position and a closed position, the fan comprising first and second spokes and a handle that couples to the spokes to form a substantially triangular arrangement when the fan is in the open position wherein:

the handle comprises a plurality of segments; and the handles comprises a first segment rotatably coupled to an end of the first spoke and a second segment rotatably coupled to an end of the second spoke, and the first and second segments are adapted to be coupled to form an elongated handle coupling the ends of the first and second spokes together.

18. A folding, hand-held fan, having a foldable material configurable between an open position and a closed position, the fan comprising first and second spokes and a handle that couples to the spokes to form a substantially triangular arrangement when the fan is in the open position wherein:

the handle is shaped to conform to the shape of a hand gripping the handle;

the handle has a cavity sized and dimensioned to receive the foldable material and the spokes, and the handle is substantially larger than the cavity and has an exterior surface dimensioned to fill the interior of a partially closed fist.

19. A folding, hand-held fan, having a foldable material configurable between an open position and a closed position, the fan comprising first and second spokes and handle that couples to the spokes to form a substantially triangular arrangement when the fan is in the open position wherein:

the first and second spokes are each coupled to a separate edge of the folded material portion of the fan;

the spokes are elongated and each have a first end rotatably coupled to a joining member;

the first spoke has a second end rotatably coupled to the handle;

the handle is adapted to be coupled to a second end of the second spoke while the fan is in the open position;

the handle and spokes are adapted to bias the handle to remain in a fixed position relative to the spokes while the fan is in the open position;

the handle has a cavity sized and dimensioned to at least partially receive the fan material and spokes when the fan is in the closed position;

the handle and spokes are adapted to bias the spokes to remain as least partially within the handle when the fan is in the closed position;

and the folded material portion of the fan comprises a reflective material and a warning, the warning comprising a symbol, word, or phrases visible from a distance of at least 100 feet while the fan is in the open position.

* * * * *